United States Patent [19]

Butts

[11] 4,171,631

[45] Oct. 23, 1979

[54] METHOD OF RESTORING DEFORMED OUTER VEHICLE PANEL TO ITS ORIGINAL CONTOUR

[76] Inventor: Clifford L. Butts, 2120 Altamont Rd., San Leandro, Calif. 94578

[21] Appl. No.: 897,506

[22] Filed: Apr. 18, 1978

Related U.S. Application Data

[63] Continuation of Ser. No. 774,589, Mar. 7, 1977, abandoned.

[51] Int. Cl.[2] ..... B21D 1/12; B21D 26/02

[52] U.S. Cl. ..... 72/54; 72/57; 72/705; 254/93 HP

[58] Field of Search ..... 72/705, 54, 56, 63, 72/392, 465, 57; 254/93 HP, 93 R; 29/401 A, 421 R

[56] References Cited

U.S. PATENT DOCUMENTS

| | | | |
|---|---|---|---|
| 2,066,085 | 12/1936 | Whistler | 29/421 R |
| 2,799,318 | 7/1957 | Blucher et al. | 72/705 |
| 2,804,118 | 8/1957 | Bayerkohler | 254/93 HP |
| 2,900,853 | 8/1959 | Steck | 72/705 |
| 3,026,541 | 3/1962 | Murat | 254/93 HP |
| 3,068,561 | 12/1962 | Jones | 29/421 R X |
| 3,180,130 | 4/1965 | Avera | 72/465 |
| 3,764,174 | 10/1973 | Taninecz | 72/705 |
| 3,982,731 | 9/1976 | Tezuka | 254/93 HP |

*Primary Examiner*—Francis S. Husar
*Assistant Examiner*—D. M. Gurley
*Attorney, Agent, or Firm*—William R. Piper

[57] ABSTRACT

A method of quickly restoring a deformed outer vehicle panel to its original contour which consists in the steps of placing a deflated inflateable air bag between the inner surface of the indented panel and against an unyielding member in the vehicle, then inflating the air bag with sufficient air pressure to force the indented panel portion back to normal contour, and, if necessary, hammering out any irregularities in the panel while the air bag still remains inflated. After the panel has been restored to normal contour, the air bag is deflated and removed.

2 Claims, 6 Drawing Figures

FIG-1-
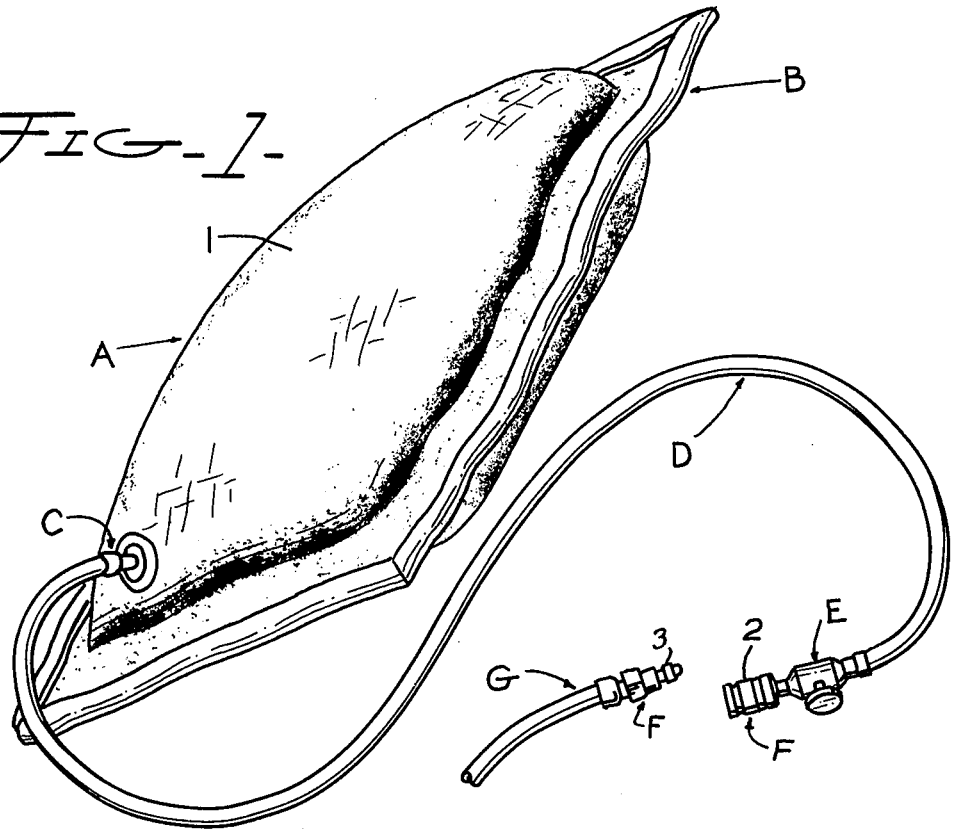
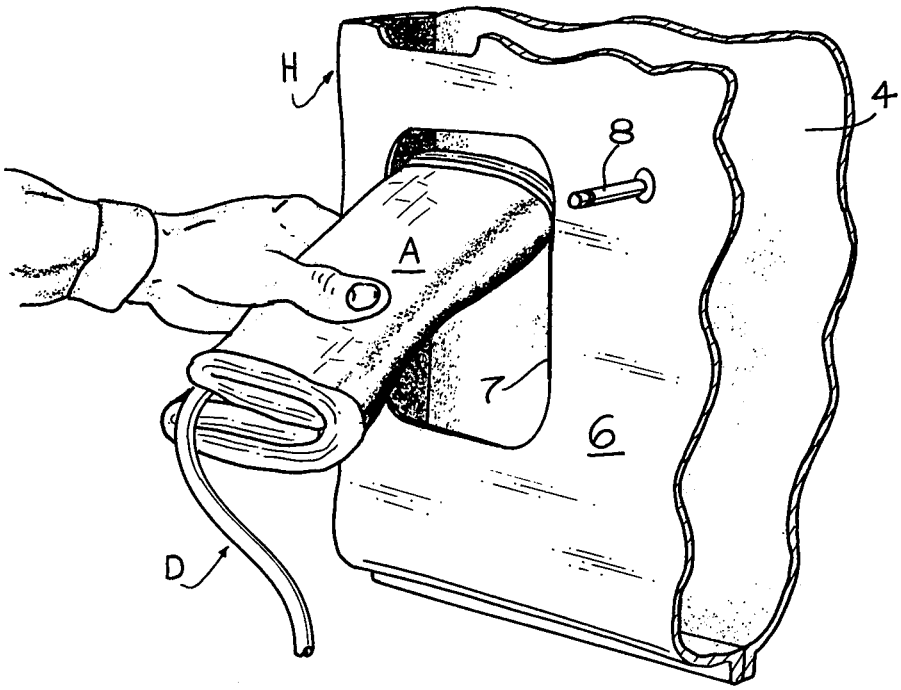
FIG-2-

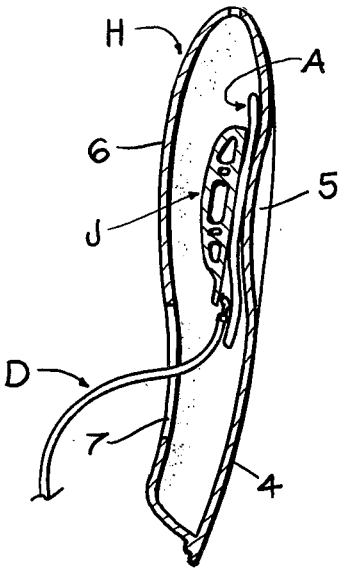
FIG. 3.
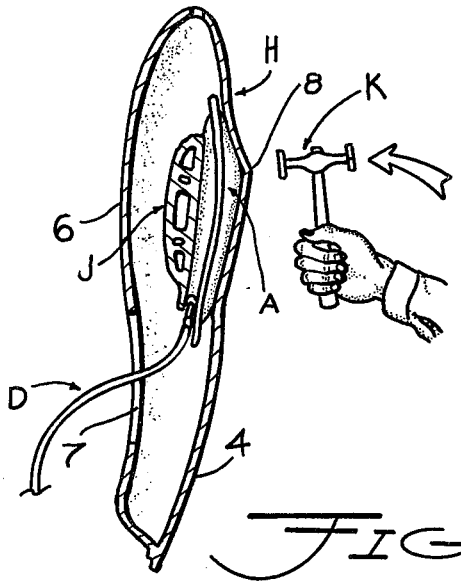
FIG. 4.
FIG. 5.
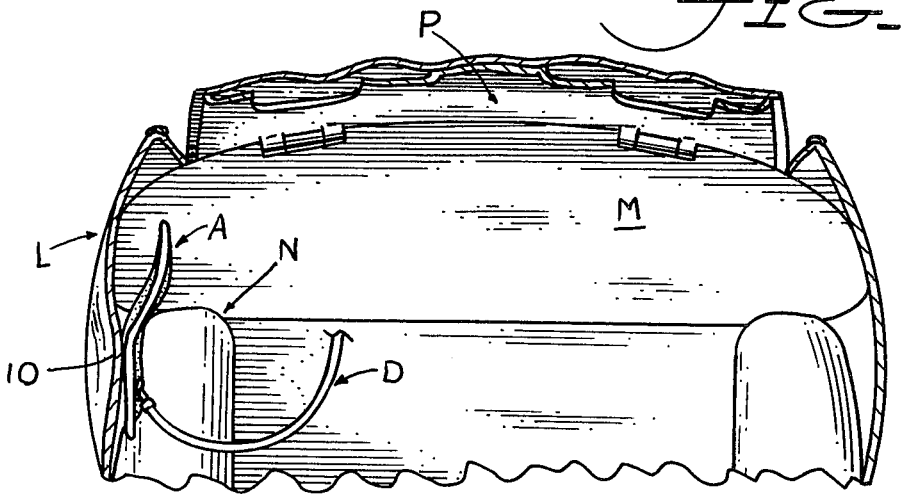
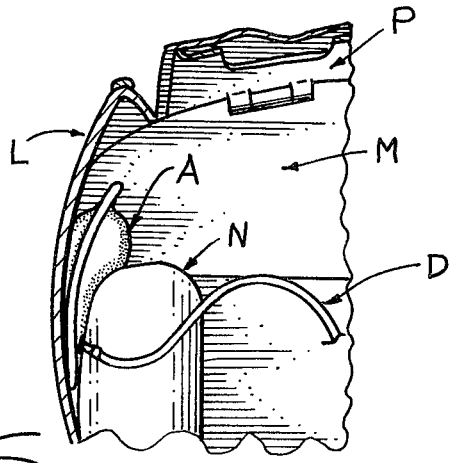
FIG. 6.

METHOD OF RESTORING DEFORMED OUTER VEHICLE PANEL TO ITS ORIGINAL CONTOUR

This is a continuation of application Ser. No. 774,589, filed Mar. 7, 1977, now abandoned.

SUMMARY OF THE INVENTION

The present practice of restoring outer vehicle panels that have been indented by an accident is to use different shaped anvils and place them against the indented portion and hammer from the opposite side to gradually force the panel back into its original contour. In the case of an indented outer panel for a vehicle door, the reinforcing door girder which lies between the inner and outer panel is so close to the indented panel portion, that it is practically impossible to do any hammering in this restricted space. It becomes necessary to remove the outer panel and replace it with a new panel.

An object of my invention is to provide an air bag which when deflated, can be positioned between the indented portion of the outer door panel and the door girder and then inflated with compressed air with sufficient force to practically pop the indentation out so that the outer panel is almost instantly returned to normal contour. If the indentation is not in an outer door panel, then the flattened deflated air bag is placed against the inner surface of the indented panel portion and against an immovable member, after which compressed air is fed into the bag interior to create sufficient force to return the indented portion to its original contour.

BRIEF DESCRIPTION OF THE DRAWINGS

FIG. 1 is a perspective view of the air bag and shows how the air inlet tube to the bag can be quickly connected to a compressed air hose, the inlet tube also being equipped with an air control valve.

FIG. 2 is an enlarged perspective view of a portion of a vehicle door where the inner door panel has an opening through which the deflated air bag may be inserted preparatory to placing the bag between the indented portion of the outer panel and an unyielding member within the hollow interior of the door such as a reinforcing door girder.

FIG. 3 is a vertical section on a smaller scale of a vehicle door showing the outer panel with an indentation and the deflated air bag positioned between the inner surface of the indented outer panel portion and the adjacent portion of the vehicle door reinforcing girder.

FIG. 4 is a sectional view similar to FIG. 3, but showing the air bag inflated with compressed air and exerting sufficient outward force against the outer panel to restore the panel contour back to normal. A hammer may be used for pounding out any minor irregularities in the shape of the outer panel.

FIG. 5 illustrates a different use of the air bag for restoring an indented portion back to normal contour of an outer vehicle panel, other than a vehicle door panel.

FIG. 6 is similar to FIG. 5 and shows the indented portion of the outer vehicle panel brought back to normal.

DESCRIPTION OF THE PREFERRED EMBODIMENT

In carrying out my method, I provide an inflatable air bag indicated generally at A, in FIGS. 1 to 6 inclusive. This air bag is preferably made from two flat pieces of Nylon or Neoprene that is reinforced with Nylon cord.

Each piece may be about one foot square although I do not want to be limited by an exact size nor to a particular type of flexible material. The four edges of the air bag are hermetically sealed together in any manner desired and I have used a binding material preferably of Nylon or Neoprene and have used an adhesive, such as a cement, for securing the binding B to the four edges of the air bag, the binding overlapping the two adjacent edges. The binding could be vulcanized to the air bag to provide an air tight seal that would withstand compressed air pressure.

An air inlet/outlet C to the interior of the air bag is connected to one side 1 of the bag A, and an air hose D, connects the air inlet/outlet to an air valve E. A quick change air coupling F, consisting of a female member 2 connected to the hose D, and a male member 3 connected to a compressed air hose G, which in turn communicates with a source of compressed air, not shown. It is well known that if the effective area of the side 1 is about ten inches square, then the area is one hundred square inches. If now only ten pounds pressure per square inch is delivered into the air bag interior, the effective outward pressure of the side 1 of the air bag against an object, such as the bent in portion of an outer vehicle panel would be about one thousand pounds and this would be more than sufficient to press the indentation outwardly so that the vehicle panel would be returned to its original contour.

I will now set forth the various steps in applying my method of restoring a deformed outer panel for a vehicle door to its original contour. In FIGS. 2, 3 and 4, I illustrate a vehicle door H. FIG. 3 is a vertical section through the vehicle door and shows the outer panel 4 with an indentation 5 therein caused by an accident or other mishap. FIG. 2 is an enlarged perspective section through a portion of the door and shows the first step in my method. The trim panel, now shown, that normally covers the inner door panel 6, has been removed and has exposed one of several openings 7 already provided in the inner panel. The operator chooses the appropriate opening 7 through which he inserts the deflated air bag A. He may have to fold the air bag into the opening 7. In the present instance, the opening 7 is near the shaft 8 for the window lift, not shown.

As soon as the operator moves the deflated air bag into the interior of the vehicle door bounded by the outer and inner panels 4 and 6, respectively, he opens the folded bag and manually moves the flattened bag into the narrow space between the inner surface of the indented portion 5 of the outer panel 4 and the adjacent surface of the support girder J which is provided in the door for reinforcing it, see FIG. 3. The air hose D, from the bag A extends through the opening 6 in the inner door panel.

The next step by the operator is to close the valve E for the air hose D, and then connect the compressed air conveying hose G to the air bag hose D by interconnecting the parts 2 and 3 of the quick change air coupling F. Care must now be exercised in opening the air valve E just enough to inflate the air bag A to the desired extent to exert sufficient force against the indented outer panel portion 5 to return it to normal contour. Then the air valve E must be closed. As already stated, a ten pound per square inch pressure in the air bag of approximately one hundred square inches in area will exert a one thousand pound force against the indented portion 5 in the outer door panel 4. This is more than enough to practically instantly force the indented portion to pop out into its normal contour form.

In FIG. 4, I show the air bag A, inflated and the indented portion 5 in the outer panel 4 has been forced out to assume its normal contour. Where the pressed out door panel portion has some slight irregular surface, such as the high point 8, still remaining, the operator may use a hammer K to pound and flatten it. This can be done against the still inflated air bag. Other portions may be smoothed in this manner and finally a rotatably sanding disc, not shown, may be used to complete the work, making the outer panel ready to be painted. Then the air valve E, is opened to deflate the bag A, whereupon the air bag may be withdrawn from the interior of the vehicle door.

FIGS. 5 and 6 show the air bag A used to restore the indented portion 10 in an outer panel L of a vehicle. The panel L forms one side wall of a luggage compartment M, and the housing N for the rear wheel is positioned close to the panel. The operator can raise the rear trunk cover P, and place the deflated air bag between the inner surface of the indented portion 10, and the adjacent surface of the rear wheel housing N. Then the operator performs the same series of steps as set forth when describing the removal of the dent 5 in the outer vehicle door panel 4.

FIG. 6 shows the air bag A, inflated and the outer vehicle panel L has been restored to its former contour. I have shown and described two ways of performing my method and these are given by way of examples.

I claim:

1. The herein described steps in restoring a deformed outer panel of a vehicle door to its original shape, the door having an inner panel with an opening therein and having an interior door reinforcing member; which consists in (a) taking a deflated air bag with flexible walls, folding it into a compact bundle, inserting it through the opening in the inner panel and moving it into the vehicle door interior, then unfolding the deflated air bag and positioning it in a flattened condition with one wall of said deflated bag facing the inner surface of the indented portion of the outer panel and the opposite wall of said deflated air bag facing the adjacent surface of the reinforcing member for the door; and (b) inflating the flattened air bag with a sufficient amount of compressed air to inflate the bag and exert a sufficient pressure that is uniformly applied to the entire area of the indented portion and to the reinforcing member for returning the indented portion to its original contour.

2. The herein described process as set forth in claim 1: and (c) in hammering out any uneven surface portions in the formerly indented outer panel while the inflated air bag is still in position and is yieldingly applying a uniform outward pressure over the entire area of the formerly indented portion.

* * * * *